US007841288B2

(12) United States Patent
Lee et al.

(10) Patent No.: US 7,841,288 B2
(45) **Date of Patent: *Nov. 30, 2010**

(54) STORAGE TANK CONTAINING LIQUEFIED NATURAL GAS WITH BUTANE

(75) Inventors: Jung Han Lee, Geoje (KR); Young Sik Moon, Geoje (KR); Dong Kyu Choi, Geoje (KR); Young Soo Kim, Geoje (KR)

(73) Assignee: Daewoo Shipbuilding & Marine Engineering Co., Ltd. (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/567,639

(22) Filed: Sep. 25, 2009

(65) Prior Publication Data

US 2010/0012015 A1 Jan. 21, 2010

Related U.S. Application Data

(63) Continuation of application No. 12/163,728, filed on Jun. 27, 2008, now Pat. No. 7,644,676.

(30) Foreign Application Priority Data

Feb. 11, 2008 (KR) ..... 10-2008-0012354

(51) Int. Cl.
*B65D 88/78* (2006.01)

(52) U.S. Cl. ..... 114/256; 62/50.2; 62/618; 114/74 A; 220/560.04

(58) Field of Classification Search ..... 114/74 A, 114/74 R, 256; 62/48.1, 50.2, 53.2, 611, 62/612, 613, 617, 620, 621, 618, 619; 220/560.04
See application file for complete search history.

(56) References Cited

U.S. PATENT DOCUMENTS

| | | | |
|---|---|---|---|
| 2,952,984 | A | 9/1960 | Marshall, Jr. |
| 3,282,060 | A | 11/1966 | Hays |
| 3,407,052 | A | 10/1968 | Huntress et al. |
| 3,420,068 | A | 1/1969 | Petit |
| 3,763,658 | A | 10/1973 | Gaumer, Jr. et al. |
| 3,837,172 | A | 9/1974 | Markbreiter et al. |
| 3,837,821 | A | 9/1974 | Buffiere et al. |
| 3,857,245 | A | 12/1974 | Jones |
| 3,874,185 | A | 4/1975 | Etzbach |

(Continued)

FOREIGN PATENT DOCUMENTS

| | | | |
|---|---|---|---|
| CN | 85105351 | A | 4/1987 |

(Continued)

OTHER PUBLICATIONS

International Search Report dated Sep. 16, 2009 of corresponding PCT Application No. PCT/KR2009/000623 filed on Feb. 11, 2008—3 pages.

(Continued)

*Primary Examiner*—Lars A Olson
(74) *Attorney, Agent, or Firm*—Knobbe Martens Olson & Bear LLP

(57) ABSTRACT

Disclosed is a liquefied natural gas composition. The composition contains methane, ethane and propane and butane. The composition contains a substantial amount of butane while being substantially free of hydrocarbon molecules larger than butane.

14 Claims, 1 Drawing Sheet

U.S. PATENT DOCUMENTS

| | | | | |
|---|---|---|---|---|
| 3,886,758 | A | 6/1975 | Perrotin et al. | |
| 4,033,135 | A | 7/1977 | Mandrin | |
| 4,041,721 | A | 8/1977 | Kniel | |
| 4,054,433 | A | 10/1977 | Buffiere et al. | |
| 4,065,278 | A | 12/1977 | Newton et al. | |
| 4,083,318 | A | 4/1978 | Verolme | |
| 4,095,546 | A | 6/1978 | Kane | |
| 4,382,524 | A * | 5/1983 | Kvamsdal | 114/74 A |
| 4,846,862 | A | 7/1989 | Cook | |
| 5,114,451 | A | 5/1992 | Rambo et al. | |
| 5,137,558 | A | 8/1992 | Agrawal | |
| 5,139,547 | A | 8/1992 | Agrawal et al. | |
| 5,325,673 | A | 7/1994 | Durr et al. | |
| 5,375,547 | A * | 12/1994 | Abe et al. | 114/74 A |
| 5,531,178 | A * | 7/1996 | Abe et al. | 114/74 A |
| 5,586,513 | A | 12/1996 | Jean et al. | |
| 5,727,492 | A | 3/1998 | Cuneo et al. | |
| 6,023,942 | A | 2/2000 | Thomas et al. | |
| 6,035,795 | A | 3/2000 | Dhellemmes et al. | |
| 6,378,722 | B1 | 4/2002 | Dhellemmes | |
| 6,530,241 | B2 | 3/2003 | Pozivil | |
| 6,564,579 | B1 | 5/2003 | McCartney | |
| 6,732,881 | B1 | 5/2004 | Gulati | |
| 6,964,181 | B1 | 11/2005 | Milios et al. | |
| 7,100,261 | B2 * | 9/2006 | Gulati | 220/560.04 |
| 7,404,301 | B2 | 7/2008 | Huang et al. | |
| 2003/0000949 | A1 | 1/2003 | Dhellemmes | |
| 2005/0042035 | A1 | 2/2005 | de Baan | |
| 2005/0126220 | A1 | 6/2005 | Ward | |
| 2007/0149838 | A1 | 6/2007 | Chretien | |
| 2008/0190117 | A1 | 8/2008 | Lee et al. | |
| 2008/0190118 | A1 | 8/2008 | Lee et al. | |
| 2008/0190352 | A1 | 8/2008 | Lee et al. | |
| 2009/0199591 | A1 | 8/2009 | Lee et al. | |
| 2009/0211262 | A1 | 8/2009 | Lee et al. | |
| 2009/0259081 | A1 | 10/2009 | Lee et al. | |
| 2009/0266086 | A1 | 10/2009 | Lee et al. | |
| 2010/0122542 | A1 | 5/2010 | Choi et al. | |

FOREIGN PATENT DOCUMENTS

| | | | |
|---|---|---|---|
| EP | 0293832 | A2 | 12/1988 |
| EP | 0535752 | A1 | 4/1993 |
| EP | 1561683 | A1 | 8/2005 |
| JP | 46-20123 | A | 6/1971 |
| JP | 58-046299 | A | 3/1983 |
| JP | 58-072800 | A | 4/1983 |
| JP | 10-028837 | A | 2/1998 |
| JP | 2005-320311 | A | 11/2005 |
| JP | 2007-527445 | A | 9/2007 |
| KR | 10-1990-0005143 | A | 4/1990 |
| KR | 10-0184706 | B1 | 5/1999 |
| KR | 10-1999-0046828 | A | 7/1999 |
| KR | 10-2000-0011346 | A | 2/2000 |
| KR | 10-2000-0011347 | A | 2/2000 |
| KR | 10-2001-0014021 | A | 2/2001 |
| KR | 10-2001-0014033 | A | 2/2001 |
| KR | 10-0289546 | B1 | 5/2001 |
| KR | 10-2001-0049264 | A | 6/2001 |
| KR | 10-2001-0060256 | A | 7/2001 |
| KR | 10-2001-0082235 | A | 8/2001 |
| KR | 10-2001-0083920 | A | 9/2001 |
| KR | 10-2001-0088406 | A | 9/2001 |
| KR | 10-2001-0089142 | A | 9/2001 |
| KR | 10-2004-0015294 | A | 2/2004 |
| KR | 10-2004-0018265 | A | 3/2004 |
| KR | 10-2004-0046835 | A | 6/2004 |
| KR | 10-2004-0046836 | A | 6/2004 |
| KR | 10-0441857 | A | 7/2004 |
| KR | 10-0489804 | A | 5/2005 |
| KR | 10-0499710 | B1 | 7/2005 |
| KR | 10-2005-0094798 | A | 9/2005 |
| KR | 10-2005-0094799 | A | 9/2005 |
| KR | 20-0394721 | Y1 | 9/2005 |
| KR | 10-2005-0102681 | A | 10/2005 |
| KR | 10-2006-0036441 | A | 4/2006 |
| KR | 10-2006-0083727 | A | 7/2006 |
| KR | 10-0618735 | B1 | 8/2006 |
| KR | 10-0644217 | B1 | 11/2006 |
| KR | 20-0431697 | Y1 | 11/2006 |
| KR | 20-2006-0000158 | U | 12/2006 |
| KR | 10-0674451 | B1 | 1/2007 |
| KR | 10-2007-0020162 | A | 2/2007 |
| KR | 10-2007-0045172 | A | 5/2007 |
| KR | 10-2007-0084510 | A | 8/2007 |
| KR | 10-2007-0091323 | A | 9/2007 |
| KR | 10-2007-0100760 | A | 10/2007 |
| WO | 90-00589 | A1 | 1/1990 |
| WO | 98/43029 | A1 | 10/1998 |
| WO | 98/59084 | A1 | 12/1998 |
| WO | 98/59085 | A1 | 12/1998 |
| WO | 00/23164 | A2 | 4/2000 |
| WO | 00/25061 | A1 | 5/2000 |
| WO | 02-32810 | A1 | 4/2002 |
| WO | 03/002921 | A1 | 1/2003 |
| WO | 2005/015100 | A1 | 2/2005 |
| WO | 2005/047761 | A1 | 5/2005 |
| WO | 2005/056377 | A2 | 6/2005 |
| WO | 2005/071333 | A1 | 8/2005 |

OTHER PUBLICATIONS

Written Opinion dated Sep. 16, 2009 of corresponding PCT Application No. PCT/KR2009/000623 filed on Feb. 11, 2008—4 pages.

International Code for the Construction and Equipment of Ships Carrying Liquefied Gases in Bulk (IGC Code), 1993, pp. 31-34, IMO, London.

International Code for the Construction and Equipment of Ships Carrying Liquefied Gases in Bulk (IGC Code), 2000, Chapter 15, IMO, London.

* cited by examiner

STORAGE TANK CONTAINING LIQUEFIED NATURAL GAS WITH BUTANE

CROSS-REFERENCE TO RELATED APPLICATION

This application is a continuation application of U.S. patent application Ser. No. 12/163,728 filed Jun. 27, 2008, and further claims priority to and the benefit of Korean Patent Application No. 10-2008-0012354 filed Feb. 11, 2008, the disclosure of which is incorporated herein by reference in their entirety. This application is related to and incorporates herein by reference the entire contents of the following application:

| Title | Filing Date | Application Ser. No. |
|---|---|---|
| LIQUEFIED NATURAL GAS WITH BUTANE AND METHOD OF STORING AND PROCESSING THE SAME | Jun. 27, 2008 | 12/163,742 |

BACKGROUND

1. Field

The present disclosure relates to liquefied natural gas, and more particularly, to a method for transporting and processing liquefied natural gas with butane component.

2. Discussion of the Related Technology

In recent, the amount of consumption of natural gas has been increased rapidly throughout the world. The gas well at which natural gas is produced is generally far away form consumers at which natural gas is consumed. Accordingly, natural gas which is in a gas state is transported through a gas pipe line installed on the land or in the sea, or natural gas which is in a liquefied natural gas (LNG) state is transported by an LNG carrier (LNG transport vessel) to distant consumers while the liquefied natural gas is stored in the LNG carrier. Liquefied natural gas is produced by cooling natural gas at an extremely low temperature of approximately −163° C., and a volume of the liquefied natural gas is approximately 1/600 of a volume of natural gas which is in a gas state, so that marine transportation is suitable for a long-distance transportation of liquefied natural gas.

Immediately after natural gas is produced from a gas well, impurities such as moisture, carbon dioxide and the like as well as various hydrocarbon components are contained in the natural gas. Such impurities may cause problems in that when natural gas is cooled at extremely low temperature, the impurities are cooled to clog pipe lines of facilities for forming or treating liquefied natural gas.

Before natural gas is liquefied, accordingly, all components capable of being cooled should be removed from the natural gas. In general, moisture, carbon dioxide and heavier hydrocarbon components comprising 5 or more carbon atoms ($C_{5+}$) contained in natural gas are separated from natural gas before the liquefaction of the natural gas.

Generally, hydrocarbon components except methane, i.e., ethane, propane and butane ($C_2$~$C_4$), are separated during the liquefaction of natural gas, and the natural gas is divided into the various hydrocarbon components. Then, the respective components are separately stored and transported to supply them to consumers. Gas produced by liquefying gas having separated propane and butane as a main component is called as liquefied petroleum gas (hereinafter, referred to as "LPG") and is widely used as industrial or household fuel.

Various methods for liquefying natural gas, including the step of separating natural gas into hydrocarbon components except methane at a low temperature, have been disclosed. These methods of liquefying natural gas are disclosed in U.S. Pat. Nos. 3,763,658, 4,065,278 and 5,325,673, European Patent No. 0,535,752, WO 90/00589, and the like. In addition, WO 2002/32810 and Japanese Patent Laid Open Publication No. 10-28837 disclose a pretreatment process for removing various impurities before liquefying natural gas.

On the other hand, LNG transported to a consumer is re-gasified and then is supplied in a gas state to consumers. At this time, there is need to adjust a heating value of natural gas, which is re-gasified and supplied to the consumer, required according to a Wobbe Index. The Wobbe Index (WI), which is an index indicating the magnitude of input heat energy with respect to a combustor, is represented by a function of heating value and specific gravity and used as a measure for determining the gas compatibility. If a heating value of the transported natural gas is higher than a standard heating value required by a consumer, the proper amount of nitrogen is mixed to the natural gas.

The foregoing discussion in this section is to provide general background information, and does not constitute an admission of prior art.

SUMMARY

One aspect of the invention provides a method of processing a liquefied natural gas composition. The method comprises: providing a storage tank; establishing a fluid communication between the storage tank and a carrier tank of a tank ship containing a liquefied natural gas composition comprising methane, ethane and propane and butane, wherein the composition contains a substantial amount of butane while being substantially free of hydrocarbon molecules larger than butane; and receiving the composition from the carrier tank into the storage tank.

In the foregoing method, the composition within the carrier tank may have a vapor pressure of about 2.5 bar or smaller and a temperature from about −159° C. to about −140° C. The vapor pressure may be about 0.7 bar or smaller. The vapor pressure may be about 0.25 bar or smaller. The composition within the carrier tank may have a temperature from about −159° C. to about −140° C. The method may have maintaining the received composition in the storage tank at a vapor pressure of about 2.5 bar or smaller. The method may have maintaining the received composition in the storage tank at a temperature from about −159° C. to about −140° C.

Still in the foregoing method, the received composition may be in an amount greater than about 100,000 $m^3$. The carrier tank may have a volume greater than about 100,000 $m^3$. The composition may contain butane in an amount from about 0.1 weight % to about 5 weight % of the total amount of the composition. The butane may be in an amount from about 2 weight % to about 4.5 weight % of butane of the total amount of the composition.

Further in the foregoing method, the method may further comprise: vaporizing at least a portion of the composition in the storage tank, thereby obtaining a vaporized natural gas; separating at least part of propane and butane from the composition or the vaporized natural gas, thereby obtaining a separated hydrocarbon gas comprising propane and butane, wherein the separated hydrocarbon gas has a heating value greater than that of the vaporized natural gas, wherein the heating value is measured in a unit of energy/mol; and transferring, via a pipe, the vaporized natural gas to a vaporized natural gas distribution network. The storage tank may be located in an offshore site, wherein vaporizing and separating may be carried out in the offshore site. The method may further comprise liquefying, in the offshore site, the separated hydrocarbon gas; and storing, in an additional storage tank, the liquefied hydrocarbon gas. Separating may be performed before or during vaporizing. The separated hydrocarbon gas may further comprise ethane.

Another aspect of the invention provides a liquefied natural gas composition being transferred from a tank ship and entering into a storage tank and, the composition comprising methane, ethane, propane and butane, wherein the composition contains a substantial amount of butane while being substantially free of hydrocarbon molecules having a molecular weight larger than butane.

In the foregoing composition, the composition may have a temperature from about −159° C. to about −140° C. The composition may contain butane in an amount from about 0.1 weight % to about 5 weight % of the total amount of the composition. The butane is in an amount from about 2 weight % to about 4.5 weight % of the total amount of the composition. The liquefied natural gas composition may be produced by a method comprising: obtaining natural gas from a natural gas well; and liquefying the natural gas without removing therefrom a substantial amount of butane and without adding thereto a substantial amount of at least one selected from the group consisting of ethane, propane and butane. The method may further comprise removing a substantial amount of hydrocarbon molecules larger than butane from the natural gas.

Still another aspect of the invention provides a liquefied natural gas plant comprising: a storage tank; and a liquefied natural gas composition contained in the storage tank, wherein the composition comprises methane, ethane, propane and butane, wherein the composition contains a substantial amount of butane while being substantially free of hydrocarbon molecules having a molecular weight larger than butane.

In the foregoing plant, the composition in the storage tank may have a vapor pressure of about 2.5 bar or smaller and a temperature from about −159° C. to about −140° C. The vapor pressure may be about 0.7 bar or smaller. The vapor pressure may be about 0.25 bar or smaller. The composition may have a temperature from about −159° C. to about −140° C. The storage tank has a volume greater than about 100,000 $m^3$. The composition may contain butane in an amount from about 0.1 weight % to about 5 weight % of the total amount of the composition. The butane may be in an amount from about 2 weight % to about 4.5 weight % of the total amount of the composition.

Still in the foregoing plant, the composition may be produced by a method comprising: obtaining natural gas from a natural gas well; and liquefying the natural gas without removing therefrom a substantial amount of butane and without adding thereto a substantial amount of at least one selected from the group consisting of ethane, propane and butane, thereby obtaining the composition. The method may further comprise removing a substantial amount of hydrocarbon molecules larger than butane from the natural gas. The plant may further comprise a natural gas processor configured to vaporize at least part of the composition and separate a substantial amount of propane and butane contained in the composition so as to obtain a vaporized natural gas and a separated hydrocarbon gas, wherein the separated hydrocarbon gas comprises the at least part of propane and butane separated from the liquefied natural gas, wherein the separated hydrocarbon gas has a heating value greater than that of the vaporized natural gas, wherein the heating value is measured in a unit of energy/mol. The plant may further comprise: a liquefier configured to liquefy the separated hydrocarbon gas; and an second storage tank configured to store the liquefied hydrocarbon gas. The separated hydrocarbon gas may further comprise ethane. The plant may be located at an offshore site.

A further aspect of the invention provides an LNG tank ship carrying a liquefied natural gas composition. The ship comprises: an LNG tank integrated in a body of the ship; a liquefied natural gas composition contained in the LNG tank, wherein the composition comprises methane, ethane and propane, wherein the composition comprises a substantial amount of butane while being substantially free of hydrocarbon molecules having a molecular weight larger than butane.

In the foregoing ship, the composition may have a vapor pressure equal to or smaller than about 2.5 bar and a temperature from about −159° C. to about −140° C. The vapor pressure may be equal to or smaller than about 0.7 bar. The vapor pressure may be equal to or smaller than about 0.25 bar. The composition may have a temperature from about −159° C. to about −140° C. The composition contained in the LNG tank may have a volume greater than about 100,000 $m^3$. The composition may contain butane in an amount from about 0.1 weight % to about 5 weight % of the total amount of the composition. The butane may be about 2 weight % to about 4.5 weight % of butane. The composition may be produced by a method comprising: obtaining natural gas from a natural gas well; and liquefying the natural gas without removing therefrom a substantial amount of butane and without adding thereto a substantial amount of at least one selected from the group consisting of ethane, propane and butane, thereby obtaining the composition. The method may further comprise removing a substantial amount of hydrocarbons larger than butane from the obtained natural gas.

An aspect of the present invention is to provide a method and system for supplying natural gas, wherein after transporting natural gas consisting of various hydrocarbon components without separating the natural gas into respective components, natural gas can be separated into respective components at a consuming area and utilize them as occasion demands, so that it is possible to omit an unnecessary separating process in a producing area and to simply adjust a heating value by adjusting the amount of liquefied petroleum gas (LPG) component to be separated according to a heating value required by a consumer.

An aspect of the present invention provides a method for supplying natural gas produced from a gas well to a consumer. The method comprises the steps of liquefying produced natural gas; transporting the liquefied gas; and separating hydrocarbon components contained in the liquefied gas transported to a consumer.

The step of separating hydrocarbon components comprises the step of separating transported natural gas into a first stream in which a hydrocarbon component having a high heating value is abundant and a second stream in which a hydrocarbon component having a low heating value is abundant.

The method further comprises the step of separating a component capable of being cooled during the liquefaction of natural gas from the natural gas before the step of liquefying natural gas.

The method further comprises the step of re-gasifying the second stream to supply it to a consumer and cooling the first stream to store it after the step of separating hydrocarbon components.

The first stream is cooled by using cold heat generated when the second stream is re-gasified.

According to another aspect of the present invention, there is provided a system for supplying natural gas produced from a gas well to a consumer, wherein the system performs the aforementioned natural gas supplying method.

According to a further aspect of the present invention, there is provided a method for supplying a consumer with natural gas, which is produced from a gas well in a state where a hydrocarbon component having a small molecular weight is mixed with a hydrocarbon component having a large molecular weight. The method comprises the steps of liquefying natural gas having LPG components in produced natural gas; and transporting the liquefied gas to a consumer.

The method further comprises the step of separating the LPG component contained in the liquefied gas after the step of transporting the liquefied gas.

The amount of the LPG component to be separated is adjusted according to a standard of a heating value of the natural gas required by a consumer.

The method further comprises the step of re-gasifying the liquefied gas except the separated LPG component after the step of separating the LPG component.

The method further comprises the step of cooling and then storing the separated LPG component after the step of separating the LPG component.

The method further comprises the step of re-gasifying the liquefied gas except the separated LPG component and simultaneously cooling and storing the separated LPG component after the step of the separating LPG component; and the separated LPG component is cooled by cold heat generated when the liquefied gas is re-gasified.

According to a still further aspect of the present invention, there is provided a system for supplying a consumer with natural gas, wherein the system performs the aforementioned natural gas supplying method.

The system comprises liquefying facilities for liquefying natural gas and a storage tank for storing the liquefied gas.

The system comprises separating facilities for separating an LPG component from the natural gas; LNG re-gasification facilities for re-gasifying the LNG; LPG cooling facilities for cooling the separated LPG component; and an LPG storage tank for storing the cooled LPG component.

The liquefying facilities and the storage tank are installed to an LNG floating production storage and offloading (FPSO).

The LNG re-gasification facilities, the LPG cooling facilities and the LPG storage tank are installed to an LNG floating storage and re-gasification unit (FSRU).

DETAILED DESCRIPTION OF EMBODIMENTS

Figure 1:
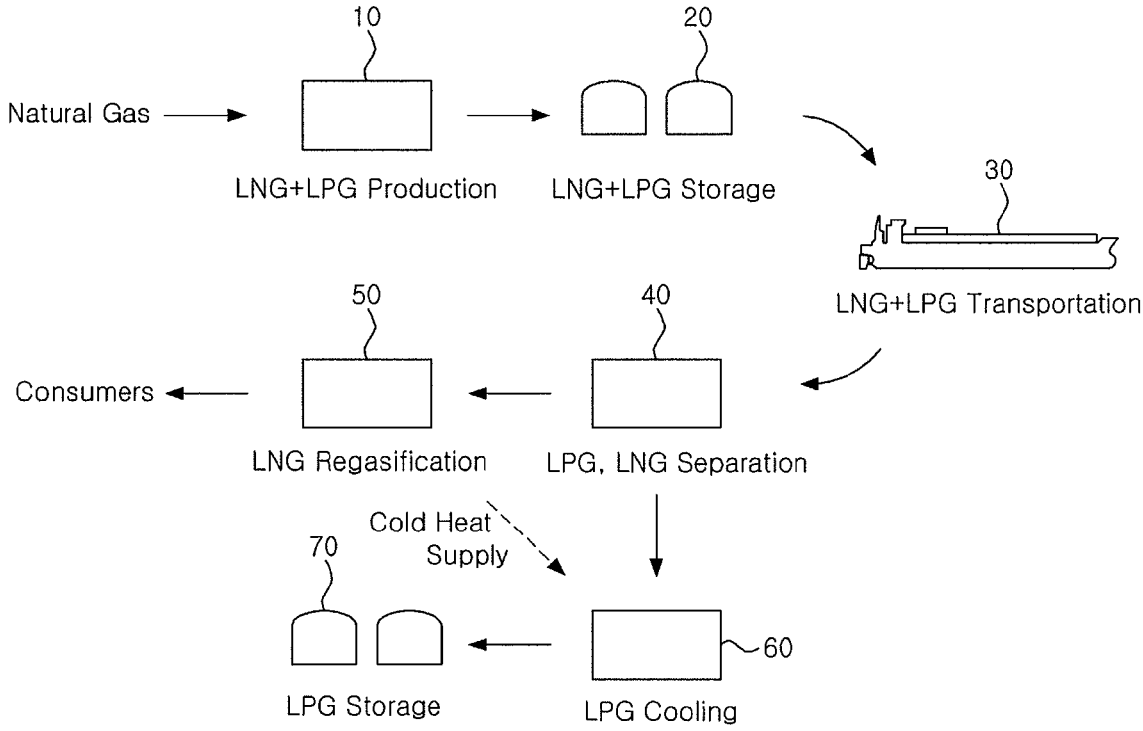
FIG. 1 is a schematic flowchart for illustrating a method for supplying natural gas one embodiment according to the present invention.

Hereinafter, embodiments of the present invention will be described in detail with reference to the drawing.

Typical Natural Gas Process and Transportation

As discussed in the background section, before liquefying natural gas extracted from a gas well, water or moisture, carbon dioxide and hydrogen sulfide and other solid-forming components are removed. Further, $C_{5+}$ hydrocarbon components are separated from the raw natural gas.

During the liquefaction of the natural gas, ethane, propane and butane are separated from the natural gas and form a hydrocarbon composition. Typically, part of ethane, all of propane and butane are removed from the natural gas. The liquefied composition of the separated hydrocarbon gas composition is generally called LPG (liquefied petroleum gas). The LPG is remotely transported by LPG tank ships which are specially designed to carry the LPG. The remaining natural gas has mainly methane and a small amount of ethane. The liquefied composition of the remaining natural gas is typically called as LNG. This typical LNG is remotely transported by LNG tank ships which are specially designed to carry the typical LNG. As such, the separation of LPG gas from the natural gas before transportation needs two kinds of specially designed tank ships.

Addition of Some Components to Natural Gas and Transportation

The WO90/00589 reference, listed in the background section, discloses a different process from the typical natural gas process discussed in the above. In the process disclosed in the reference, an organic conditioner of ethane, propane, butane or carbon dioxide is added to the natural gas so as to form altered gas, and then, the altered gas is liquefied into a single, liquefied heavy gas (LHG).

Pentane and heavier hydrocarbon ($C_{5+}$ hydrocarbon) contained in the natural gas are not separated. This provides less pretreatment before liquefying, reduction of need for handling the separated $C_{5+}$ component and overall thermal efficiency greater than the typical LNG. The LHG, however, requires a storage tank for high pressure from 34.5 to 96.5 bar, and a tank ship with the storage needs to be specially designed for such high pressure.

Unexpected Features and Results of the Invention

In certain embodiments of the invention, before liquefying natural gas, water or moisture, carbon dioxide and hydrogen sulfide and other solid-forming components are removed from raw natural gas extracted from a gas well. Further, $C_{5+}$ hydrocarbon components are separated from the raw natural gas. The process for removing ethane, propane and butane from the natural gas, however, is not provided before of during the liquefaction of the natural gas. Thus, liquefied natural gas comprises components of methane, ethane, propane and butane, which are originally contained raw natural gas. That is, the liquefied natural gas comprises components of LPG, which are originally contained raw natural gas.

And then, the liquefied natural gas is loaded in a tank ship, and then transported to a remote area where the liquefied natural gas are to be further processed and consumed with the tank ship. Since the amount of the propane and butane is small relative to that of methane, a typical LNG tank ship can be used for transportation of the liquefied natural gas that contains components of methane, ethane, propane and butane. As such, this process does not require a separate LPG tank ship.

Further, the liquefied natural gas according to embodiments of the invention does not require the high pressure tank ship which is specially designed for transporting the LHG under the high pressure as disclosed in the WO90/00589 reference. Because, in embodiments of the invention, $C_{5+}$ has been removed before or during liquefying process and no additional organic conditioner of ethane, propane, butane or carbon dioxide added to the liquefied natural gas. When considering the cost for building and operating the LPG tank ship and high pressure tank ship, the above result from the above aspects of the invention is unexpected.

Process after Transportation of Liquefied Natural Gas and Unexpected Result

Generally, a heating value of natural gas from which hydrocarbon components except methane are separated during the liquefaction is lower than that of natural gas in which hydrocarbon components except methane are not yet separated. If a heating value of the transported natural gas is still higher than a standard heating value required by a consumer, the proper amount of nitrogen is typically mixed to the natural gas. In addition, if a heating value of the transported natural gas is lower than the standard heating value required by a consumer, there is a problem in that LPG separated from the natural gas prior to the transportation should be mixed again to the natural gas. To this end, facilities for separating various hydrocarbon components of the LPG, liquefying the respective separated hydrocarbon components of the LPG and separately storing the LPG should be further provided in liquefaction facilities on a producing area. Also, facilities for adding LPG to the transported natural gas to adjust a heating value of natural gas should be further provided in re-gasification facilities of a consuming area. These may cause high cost.

In one embodiment, the liquefied natural gas transported from a remote production site is further processed at an onshore or offshore plant which located near an area where users are located. The liquefied natural gas is stored in a storage tank of the plant and then vaporized. During or after vaporizing of the liquefied natural gas into a natural gas composition, at least part of propane and/or butane is separated from the natural gas composition in order to adjust a heating value to a predetermined value. In one embodiment, the separated propane and/or butane is liquefied into LPG and stored in a LPG tank of the plant.

Embodiments of the invention will further be described below. FIG. 1 is a schematic flowchart for illustrating a method for supplying natural gas one embodiment according to the present invention. As shown in FIG. 1, according to a method of supplying natural gas according to embodiment of the present invention, natural gas produced from a gas well is liquefied and transported to a consuming area as it is, components thereof having a high heating value are separated while the liquefied gas is re-gasified in the consuming area, and then, the re-gasified gas is supplied to respective consumers.

First of all, natural gas produced at the gas well is liquefied through liquefying facilities 10 in order to store and transport the natural gas conveniently. In the liquefied gas, methane and LPG components (for example, ethane, propane and butane) are mixed. The natural gas liquefied with methane and LPG components mixed can be stored temporarily in a storage tank 20, if necessary. A tank utilized for storing typical LNG can be employed as the above storage tank 20 as it is.

According to embodiments of the present invention, since there is no need to additionally separate LPG component in the liquefying facilities 10 of a producing area, facilities for separating LPG component need not be installed.

According to embodiments of the present invention, the liquefying facilities 10 and the storage tank 20 may be installed to a floating type maritime structure, such as an LNG floating production storage and offloading (FPSO). The LNG FPSO is the floating type maritime structure used for liquefying the produced natural gas directly on the sea, storing it in a storage tank, and delivering the LNG stored in the storage tank to an LNG transport vessel when necessary.

Impurities such as moisture, carbon dioxide and the like as well as various hydrocarbon components are contained in natural gas immediately after it is produced from a gas well. Such impurities may cause problems in that when natural gas is cooled at extremely low temperature, the impurities are cooled to clog pipe lines of facilities for forming or treating liquefied gas. Accordingly, all components capable of being cooled such as moisture, carbon dioxide, heavy hydrocarbon components comprising at least five (5) carbon atoms ($C_{5+}$) are removed from the natural gas prior to the liquefaction of the natural gas.

Typical equipments can be utilized as the aforementioned liquefying facilities 10 and storage tank 20. Although LPG component, which is liquefied first during a liquefaction process, is separated in a prior art, all hydrocarbon components are liquefied and stored in a mixed state without separating separately various hydrocarbon components in order in which liquefactions occur according to the present invention. Accordingly, in the present invention, since there is no need to perform a process of separating LPG component when natural gas is liquefied, there is an advantage in that an overall system is simplified and the storage facilities are also simplified.

Consequently, the natural gas (mixture of methane and LPG components) liquefied and temporarily stored in the storage tank 20 is transported from a producing area to a consuming area by an LNG transport vessel 30, an LNG re-gasification vessel (RV; not shown) and a gas pipe lines (not shown) provided on the land or in the sea. The means used for transporting typical LNG can be utilized as the LNG transport vessel 30 or the LNG re-gasification vessel, as it is.

On the consuming area, LGP components are separated from the natural gas, in which methane and LPG components are mixed and liquefied, by separating facilities 40, and the LPG components and the remaining natural gas components are then stored or supplied to respective consumers.

Since LPG component, i.e., ethane, propane or butane, have two or more carbon atoms, LPG component have a heating value larger than that of the remaining natural gas components having mainly methane in which one carbon atom is a main component. Accordingly, since the natural gas from which LPG component is not removed has a significant high heating value, an embodiment of the present invention has an advantage in that there is no need to provide facilities for increasing heating value according to a demand of a consumer.

However, if a heating value required in a consuming area is smaller than that of the transported liquefied gas, the desired heating value can be obtained by removing LPG component in the separating facilities 40. That is, in a consuming area requiring a relatively high heating value, a relative small amount of LPG component is separated, and then, the natural gas is re-gasified and supplied, whereas in a consuming area requiring a relatively low heating value, a relative large amount of LPG component is separated, and then, the natural gas is re-gasified and supplied. According to embodiments of the present invention as described above, the separating facilities 40 for separating LPG component are provided in a consuming area. After LPG component is separated in the separating facilities 40, remaining natural gas containing methane as a main component is re-gasified in LNG re-gasification facilities 50 and then supplied to respective consumers. In addition, the separated LPG component is cooled through LPG cooling facilities 60, so that the LPG component is condensed and then stored in an LPG storage tank 70. If necessary, the stored LPG component can be contained in a small-sized pressure container and then supplied to a consumer such as homes or factories.

Since the temperature of liquefaction of LPG component is higher than that of remaining liquefied natural gas, it is preferable in an energy efficiency aspect that cold heat generated when the liquefied natural gas is re-gasified in the LNG re-gasification facilities 50 is utilized as cold heat required for cooling LPG component in the LPG cooling facilities 60.

According to embodiments of the present invention, the separating facilities 40, the LNG re-gasification facilities 50 and the LPG cooling facilities 60 may be provided on the maritime structure such as an LNG floating storage and re-gasification unit (FSRU). The LNG FSRU is a floating type maritime structure, which stores liquefied gas, which is unloaded from the LNG transport vessel, in a storage tank on the sea far away from the land and then gasifies the liquefied gas, if necessary, and supplies the gasified natural gas to a consumer on the land.

According to embodiments of the present invention, it is possible to provide a method and system for supplying natural gas, wherein after transporting natural gas consisting of various hydrocarbon components without separating the natural gas into respective components, natural gas can be separated into respective components at consumers and utilize them as occasion demands.

Thus, according to embodiments of the present invention, it is possible to omit an unnecessary separating process in a producing area and to simply adjust a heating value by adjusting the amount of LPG component to be separated according to a heating value required by a consumer.

Although embodiments of the present invention have been described with reference to the drawing, the present invention is not limited to the embodiment and drawing illustrated above. It will be apparent that those skilled in the art can make various modifications and changes thereto within the scope of the invention defined by the claims.

What is claimed is:

1. A liquefied natural gas plant comprising:

a storage tank configured to store liquefied natural gas;

a liquefied natural gas composition contained in the storage tank, wherein the liquefied natural gas composition comprises methane, ethane, propane and butane, wherein the liquefied natural gas composition contains a substantial amount of butane while being substantially free of hydrocarbon molecules having a molecular weight larger than butane; and a natural gas processor configured to receive the liquefied natural gas composition from the storage tank and to separate therefrom a substantial amount of propane and butane, wherein the natural gas processor is in the downstream of the storage tank, and wherein the plant does not comprise in the upstream of the storage tank another processor configured to separate a substantial amount of propane and butane from liquefied natural gas prior to storing in the storage tank.

2. The plant of claim 1, wherein the composition in the storage tank has a vapor pressure of about 2.5 bar or smaller and a temperature from about −159° C. to about −140° C.

3. The plant of claim 2, wherein the vapor pressure is about 0.7 bar or smaller.

4. The plant of claim 2, wherein the vapor pressure is about 0.25 bar or smaller.

5. The plant of claim 1, wherein the composition has a temperature from about −159° C. to about −140° C.

6. The plant of claim 1, wherein the storage tank has a volume greater than about 100,000 $m^3$.

7. The plant of claim 1, wherein the composition contains butane in an amount from about 0.1 weight % to about 5 weight % of the total amount of the composition.

8. The plant of claim 1, wherein butane is in an amount from about 2 weight % to about 4.5 weight % of the total amount of the composition.

9. The plant of claim 1, wherein the composition is produced by a method comprising:

obtaining natural gas from a natural gas well; and liquefying the natural gas without removing therefrom a substantial amount of butane and without adding thereto a substantial amount of at least one selected from the group consisting of ethane, propane and butane, thereby obtaining the composition.

10. The plant of claim 9, wherein the method further comprises removing a substantial amount of hydrocarbon molecules larger than butane from the natural gas.

11. The plant of claim 1, wherein the plant is located near a shore or on an offshore floating structure, wherein the plant is not connected via pipes with a liquefied natural gas well or a remote natural gas supply such that the plant is capable of processing liquefied natural gas unloaded only from an LNG tank ship docked near the plant.

12. The plant of claim 1, wherein the plant is located on an offshore floating structure.

13. The plant of claim 12, wherein the offshore floating structure comprises an LNG FSRU.

14. A ship comprising the plant of claim 1.

* * * * *